United States Patent [19]

Tamada

[11] Patent Number: 4,582,498

[45] Date of Patent: Apr. 15, 1986

[54] TOY WITH FLOATING ORNAMENT ENCLOSED IN TRANSPARENT VESSEL

[75] Inventor: Koji Tamada, Chiyoda, Japan

[73] Assignee: Tamada Giken Kabushiki Kaisha, Japan

[21] Appl. No.: 683,921

[22] Filed: Dec. 20, 1984

[30] Foreign Application Priority Data

Dec. 22, 1983 [JP] Japan ..... 58-197688[U]

[51] Int. Cl.[4] ..... A63H 3/52

[52] U.S. Cl. ..... 446/267; 446/160; 446/325

[58] Field of Search ..... 446/267, 155, 176, 180, 446/199, 156, 159, 160, 325, 326; 40/409, 406, 422, 310

[56] References Cited

U.S. PATENT DOCUMENTS

| | | | |
|---|---|---|---|
| 909,467 | 1/1909 | Shaw | 446/267 |
| 2,290,067 | 7/1942 | Parsons | 446/156 |
| 2,305,890 | 12/1942 | Moore | 40/310 |
| 3,229,419 | 1/1966 | Fry | 446/155 |
| 3,535,805 | 10/1970 | Peiperl | 40/406 |
| 3,613,264 | 10/1971 | Vitka et al. | 272/8 R |
| 3,777,379 | 12/1973 | Lewellen | 40/406 |
| 4,176,469 | 12/1979 | Timco | 40/406 |
| 4,419,283 | 12/1983 | Schneider | 40/406 |

*Primary Examiner*—Robert A. Hafer
*Assistant Examiner*—Daniel Nolan
*Attorney, Agent, or Firm*—Price, Heneveld, Huizenga & Cooper

[57] ABSTRACT

Herein disclosed is a toy having a floating ornament enclosed in a transparent vessel, which toy comprises: a transparent bottle; two kinds of liquids having different specific gravities and the properties of not mixing with each other and filling up said bottle to form two upper and lower liquid layers; a floating ornament constructed of a small model made of a material having a specific gravity larger than that of the liquid forming the upper liquid layer and smaller than that of the liquid forming the lower liquid layer; and seal means hermetically sealing the mouth of said bottle, whereby said floating ornament in said bottle can move in a stable state at all times when said bottle is rocked.

2 Claims, 9 Drawing Figures

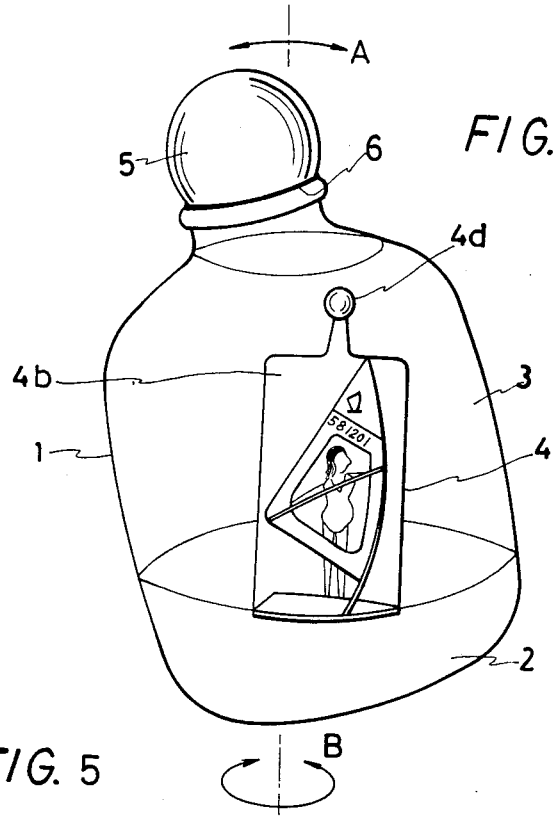
FIG. 4
FIG. 5
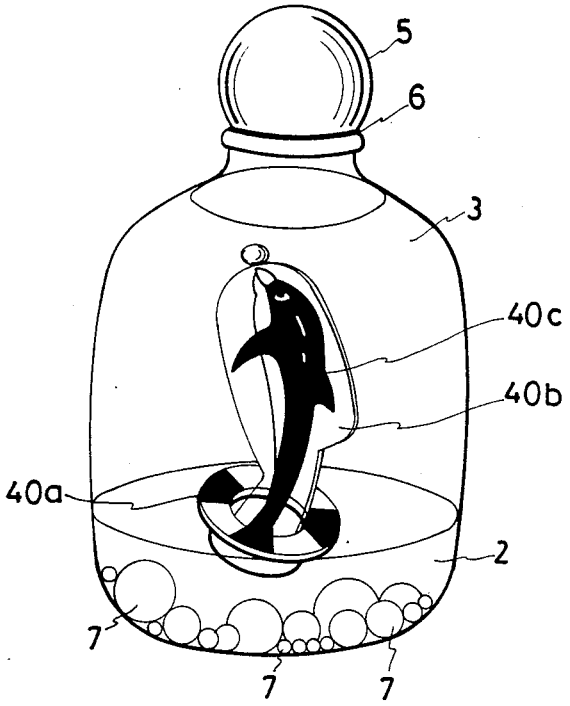
FIG. 6
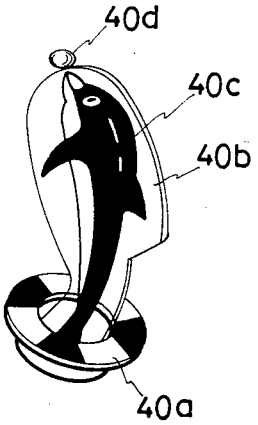

TOY WITH FLOATING ORNAMENT ENCLOSED IN TRANSPARENT VESSEL

BACKGROUND OF THE INVENTION

1. Field of the Invention

The present invention relates to a toy having a floating ornament enclosed in a transparent vessel so that the movements of the floating ornament can be enjoyably seen by rocking the vessel and, more particularly, to a toy of the above type which can also be used as an interior ornament when it is placed on a bookshelf, a desk, a table or the like.

2. Description of the Prior Art

As the toy or interior ornament of the above-specified type, there has been used in the prior art an artificial flower, which is immersed in the water in a transparent glass, or an ornament which is constructed by assembling a model such as a sailboat in an empty bottle. In this toy or ornament, however, the ornamental member such as the artificial flower or the sailboat enclosed in the vessel is liable to be broken if it is shaked. Therefore, the toy or ornament can be said nothing but a decoration and is not enjoyable because no motion can be given to the ornamental member in the vessel.

On the other hand, a sandglass clocks a predetermined time merely by dropping sand through a throat of the vessel thereof. The sandglass thus constructed is not so enjoyable. Therefore, I have proposed a sandglass (as is disclosed in U.S. Pat. No. 3,935,707) in which water fills up a vessel to drag the sand dropping from upper to lower compartments thereby to decelerate the dropping speed of the sand and in which gears are disposed just above and below the throat defining the two compartments so that they may be turned by the sand dropping from the upper compartment through the throat to the lower compartment thereby to present enjoyable sand motions in addition to the clocking action.

Although the sandglass can present the enjoyable motions of both the gears disposed in the vessel and the dropping sand, it is not suitable for an ornament while it is not used as a timing device but is placed on the bookshelf, desk or table.

On the other hand, there exists an ornament in which a transparent, rectangular box is filled up with two kinds of liquids such as petroleum and water having the properties of not mixing with each other such that the lower liquid is colored blue whereas the upper liquid is left transparent and in which the box is actuated to make seesaw motions at all times so that the liquids therein may be moved like rolling waves. However, what can be presented by this ornament are the motions of the waves, and the ornament is not so enjoyable either.

SUMMARY OF THE INVENTION

It is, therefore, an object of the present invention to provide a toy having a floating ornament enclosed in a transparent vessel, which can interests a viewer, when used, by rocking the vessel to impart various motions to an ornamental member enclosed in the vessel.

Another object of the present invention is to provide a toy of the above type, which can also be used sufficiently as an ornament even if it is left on a bookshelf, a desk or a table.

According to a major feature of the present invention, there is provided a toy having a floating ornament enclosed in a transparent vessel, which toy comprises: a transparent bottle; two kinds of liquids having different specific gravities and the properties of not mixing with each other and filling up said bottle to form two upper and lower liquid layers; a floating ornament constructed of a small model made of a material having a specific gravity larger than that of the liquid forming the upper liquid layer and smaller than that of the liquid forming the lower liquid layer; and seal means hermetically sealing the mouth of said bottle, whereby said floating ornament in said bottle can move in a stable state at all times when said bottle is rocked.

BRIEF DESCRIPTION OF THE DRAWINGS

In FIGS. 1 to 4 showing one embodiment of the present invention:

FIG. 1 is a perspective view;

FIG. 2 is a longitudinally sectional front elevation;

FIG. 4 is a perspective view showing the embodiment in its used state.

In FIGS. 5 and 6 showing another embodiment of the present invention:

FIG. 5 is a perspective view of the same; and

FIG. 6 is a perspective view showing a floating ornament.

DESCRIPTION OF THE PREFERRED EMBODIMENT

Figure 1:
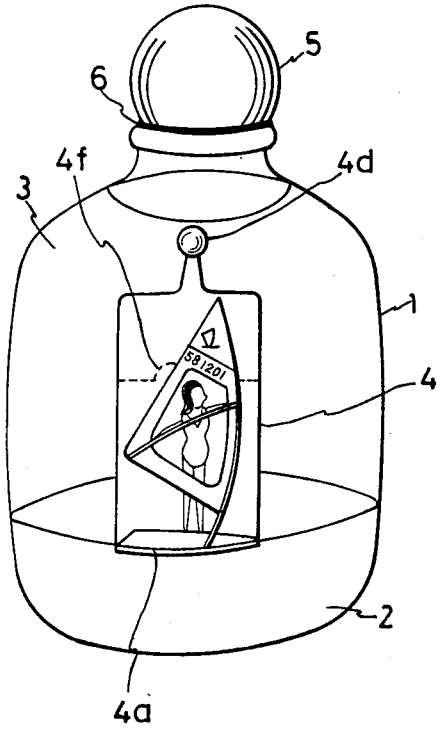
Figure 2:
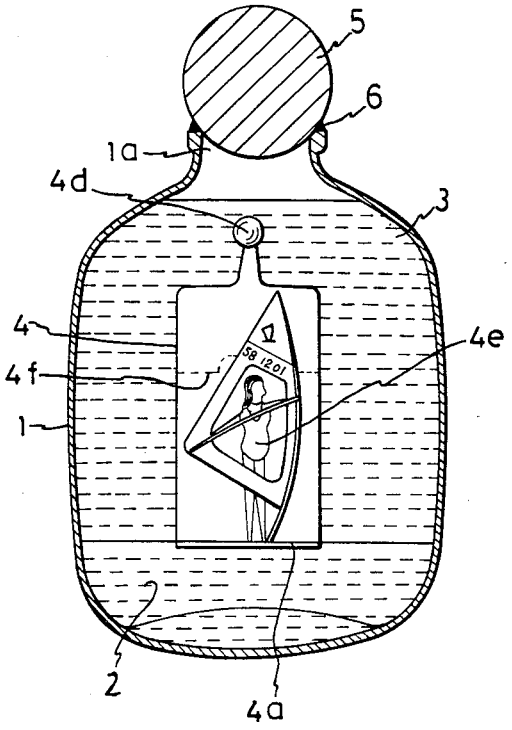
Figure 3A:
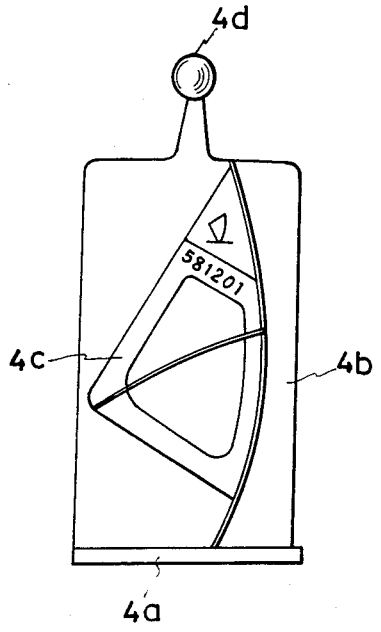
FIG. 3A is a front elevation showing a part of a floating ornament.
Figure 3B:
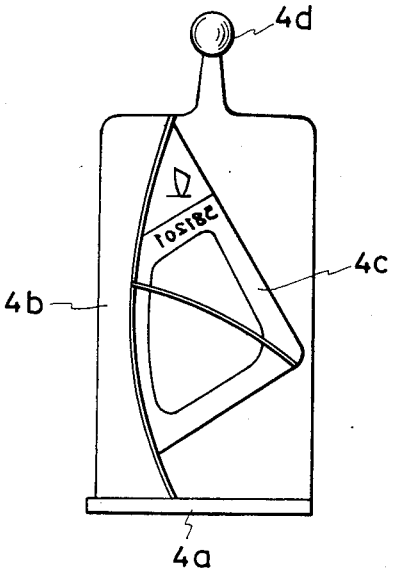
FIG. 3B is a back elevation showing the same.
Figure 3C:
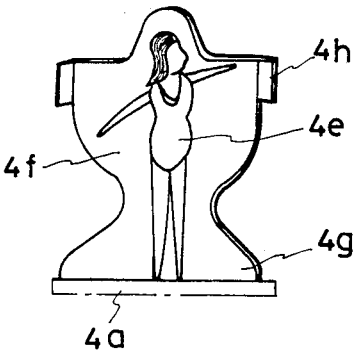
FIG. 3C is a front elevation showing another part of the floating ornament.
Figure 3D:
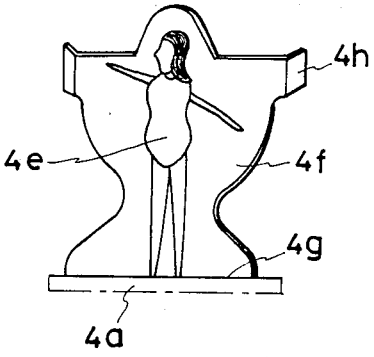
FIG. 3D is a back elevation showing the same.

A bottle 1 made of transparent glass is filled up with two kinds of liquids having the properties of not mixing with each other such as water 2 and transparent, fluid paraffin 3, and a blue dye is added to the underlying water layer so as to enhance a color effect. Those two kinds of liquids filling up the transparent bottle 1 are separated into the lower layer of the water 2 lying on the bottom of the bottle 1 and the upper layer of the transparent, fluid paraffin 3 overlying the lower layer.

A floating ornament to be enclosed in the bottle 1 can be conceived to assume a variety of forms. The floating ornament 4 according to a first embodiment is a floating body shaped to imitate the form of a wind surfer. This floating body 4 is constructed by forming a surfboard **4*a* of a small chip of a material having a specific gravity smaller than that of the water and larger than that of the fluid paraffin such as foamed styrene having independent foams or cork, and by attaching a rectangular, thin plastic sheet 4*b* to the front side of the surfboard 4*a*. More specifically, the floating ornament is constructed by printing that plastic sheet 4*b* with a wind surfing sail 4*c*, by attaching the lower end edge 4*g* of a sheet made of a material similar to the plastic sheet 4*b* and printed with a surfer 4*e* to the back of the surfboard 4*a*, by attaching the bent upper end portions 4*h* of the plastic sheet 4*f* printed with the surfer 4*e* to the back of the plastic sheet 4*b* printed with the sail 4*c*, and by attaching a float 4*d* made of foamed styrene or cork to the upper end edge of the plastic sheet 4*b***.

On the other hand, a floating ornament 40 according to a second embodiment is shaped to imitate a form in which a dolphin jumps out of a tire tube. More specifically, the floating ornament 40 is constructed by forming the tire tube 40*a* of a foamed styrene plate, by attaching a plastic sheet 40*b* printed with a drawing expressing the state, in which a dolphin 40*c* jumps up, to the tire tube 40*a*, and by attaching a ball-shaped float 40*d* of foamed styrene or cork to the upper end edge of the plastic sheet 40*b*.

When the floating ornament 40 having the construction thus far described is enclosed in the bottle 1, it sinks in the upper layer of the fluid paraffin 3 but floats on the surface 2*a* of the lower layer of the water 2. After this, the bottle 1 has its mouth 1*a* plugged hermetically with a glass ball 5 and a sealing agent 6, thus constructing the toy.

Incidentally, the water used to fill up the bottle 1 may preferably be prepared by adding salt to distilled water, and the fluid paraffin may be replaced by transparent oil. The two liquid to be used to fill up the bottle and to have the different specific gravities have such properties that they do not mix with each other but are separated into the upper and lower layers at all times. Moreover, the floating ornament may take any shape so long as it is made of a material having a specific gravity smaller than that of the water.

Since the present invention is made to have the construction described hereinbefore, the water 2 filling up the transparent bottle 1 lies in the lower portion of the bottle 1, whereas the transparent, fluid paraffin 3 is positioned to float separately on the water at all times because it has a smaller specific gravity than that of the water and has the property of not mixing with the water. In case a blue dye is added, moreover, it is dissolved in the water so that the layer of the water 2 exhibits the color of sea or lake water. When the surfboard 4*a* acting as the floating ornament is inserted into the bottle 1, moreover, it floats on the upper surface 2*a* of the water 2. Since the surfboard 4*a* is heavier than the fluid paraffin, however, it is surrounded stably by the fluid paraffin layer 3 as if it were floating on the sea surface.

If the plug 5 of the glass ball plugging the mouth of the bottle thus constructed is gripped to incline the bottle, as shown in FIG. 4, so that the bottle may be slowly rocked in the direction of arrow A or B, the liquids 2 and 3 in the bottle 1 roll so that the blue water layer moves like the rolling waves. Then, the surfboard 4*a* rocks as if it were in the surfing. Even if the bottle is thus rocked, the floating ornament 4 does not turn turtle but is kept floating on the water surface because it has the float 4*d* at its upper end edge.

In case the bottle enclosing the floating ornament is cylindrical, the fluid paraffin in the bottle provides a focusing lens effect so that the motions of the floating ornament can be observed clearly. When the toy thus constructed is placed on the desk or the like, the blue color of the dye stuff in the water is reflected through the fluid paraffin on the upper surface so that the surface of the fluid paraffin is reflected like the blue sky, whereby the ornamental effect can be enhanced together with the floating ornament. This ornamental effect can be enhanced better by inserting small glass balls 7 having red, blue and green colors in the bottle in addition to the floating ornament, as shown in the second embodiment.

Although the present invention has been described hereinbefore in connection with the embodiments thereof with reference to the accompanying drawings, it should not be limited to those embodiments but can be practised with partial modifications and additions within the gist thereof.

What is claimed is:

1. A toy having a cylindrical transparent vessel and a toy contained within said vessel, said toy comprising: said vessel being a sealed bottle of circular configuration having a rounded dome-like top; first and second liquids within said vessel, said liquids having different specific gravities and being incapable of mixing with each other for maintaining a sharply defined boundry between them; the first liquid having the higher specific gravity and being colored blue and occupying the lower portion of the vessel, and the second liquid being clear and occupying the upper portion of the vessel whereby the boundry between the liquids is clearly visible; an ornament having an elongated portion with a base portion at one end and a float at the other end; the specific gravity of the combination ornament and float being such that the ornament will float with its base portion on the first liquid while maintaining contact with the same; the buoyance of the float in the second liquid being such that it will at all times maintain the elongated portion in generally vertical position without causing separation of the base portion of the ornament from the first liquid whereby the vessel can be rocked from side to side and back to front without causing the ornament to lose its generally vertical orientation; the blue coloring of the first liquid giving it the appearance of water and the light reflected upwardly from it through the second liquid being reflected from the surface of the second liquid and the dome-like curvature of the top of the vessel to simulate the sky.

2. The toy described in claim 1 wherein said bottle has a neck defining an opening at the center of said top; means sealing said opening; said liquids substantially filling said container.

* * * * *